US009905232B2

(12) United States Patent
Hatanaka et al.

(10) Patent No.: US 9,905,232 B2
(45) Date of Patent: Feb. 27, 2018

(54) DEVICE AND METHOD FOR ENCODING AND DECODING OF AN AUDIO SIGNAL

(71) Applicant: SONY CORPORATION, Tokyo (JP)

(72) Inventors: Mitsuyuki Hatanaka, Kanagawa (JP); Toru Chinen, Kanagawa (JP); Yuki Yamamoto, Tokyo (JP); Runyu Shi, Tokyo (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 14/893,896

(22) PCT Filed: May 21, 2014

(86) PCT No.: PCT/JP2014/063411

§ 371 (c)(1),
(2) Date: Nov. 24, 2015

(87) PCT Pub. No.: WO2014/192604

PCT Pub. Date: Dec. 4, 2014

(65) Prior Publication Data

US 2016/0133260 A1 May 12, 2016

(30) Foreign Application Priority Data

May 31, 2013 (JP) ..... 2013/115726

(51) Int. Cl.
*H04S 5/00* (2006.01)
*G10L 19/008* (2013.01)
(Continued)

(52) U.S. Cl.
CPC ..... *G10L 19/008* (2013.01); *G10L 19/0017* (2013.01); *G10L 19/012* (2013.01);
(Continued)

(58) Field of Classification Search
CPC ... G10L 19/008; G10L 19/012; G10L 19/167; G10L 19/0017; H04S 5/005; H04S 2400/01; H04S 2420/03
(Continued)

(56) References Cited

U.S. PATENT DOCUMENTS

2003/0046711 A1* 3/2003 Cui ..... H04N 5/9265 725/134
2007/0018952 A1* 1/2007 Arseneau ..... G06F 1/1626 345/156
2010/0324708 A1* 12/2010 Ojanpera ..... G10L 19/008 700/94

FOREIGN PATENT DOCUMENTS

JP 63-231500 A * 3/1987
JP 63-231500 A 9/1988
(Continued)

OTHER PUBLICATIONS

International Standard ISO/IEC 14496-3; Information Technology—Coding of audio-visual objects—Part 3: Audio; 18 pages; Forth edition; Sep. 1, 2009 ; 18 pages; Published in Switzerland in English.

*Primary Examiner* — Duc Nguyen
*Assistant Examiner* — Yogeshkumar Patel
(74) *Attorney, Agent, or Firm* — Chip Law Group

(57) ABSTRACT

The present technology relates to an encoding device and method, a decoding device and method, capable of improving audio signal transmission efficiency. An identification information generation unit determines whether or not an audio signal is to be encoded on the basis of the audio signal. The identification information generation unit generates identification information indicating the determination result. An encoding unit encodes only the audio signals which are determined to be encoded. A packing unit generates a bit stream containing the identification information
(Continued)

and encoded audio signals. As a result of storing only encoded audio signals and the identification information indicating whether or not the respective audio signals are to be encoded in the bit stream, the transmission efficiency of the audio signals can be improved. The present technology can be applied to an encoder and a decoder.

11 Claims, 11 Drawing Sheets

(51) Int. Cl.
*G10L 19/00* (2013.01)
*G10L 19/012* (2013.01)
*G10L 19/16* (2013.01)

(52) U.S. Cl.
CPC ..... *G10L 19/167* (2013.01); *H04S 5/005* (2013.01); *H04S 2400/01* (2013.01); *H04S 2420/03* (2013.01)

(58) Field of Classification Search
USPC ..... 381/22; 700/94
See application file for complete search history.

(56) References Cited

FOREIGN PATENT DOCUMENTS

| | | | | |
|---|---|---|---|---|
| JP | S63-231500 | A | * | 9/1988 |
| JP | 11-167396 | A | * | 6/1999 |
| JP | H11-167396 | A | * | 6/1999 |
| JP | 11-220553 | A | | 8/1999 |
| JP | 2002-041100 | A | | 2/2002 |
| JP | 2002-99299 | A | | 4/2002 |
| WO | WO 2012/110482 | A2 | * | 8/2012 |

* cited by examiner

FIG. 3

| | 1frame | 2frame | 3frame | 4frame | 5frame | 6frame |
|---|---|---|---|---|---|---|
| CH1 | BS(1) | BS(1) | BS(1) | BS(1) | BS(1) | BS(1) |
| CH2 | BS(2) | BS(2) | BS(2) | – | BS(2) | – |
| CH3 | BS(3) | – | – | – | BS(3) | – |
| CH4 | BS(4) | – | – | BS(4) | BS(4) | – |
| CH5 | BS(5) | BS(5) | BS(5) | BS(5) | BS(5) | – |
| CH6 | BS(6) | – | – | BS(6) | BS(6) | – |
| CH7 | BS(7) | BS(7) | BS(7) | – | – | – |
| CH8 | BS(8) | BS(8) | BS(8) | – | BS(8) | – |

FIG. 4

| | 1frame | 2frame | 3frame | 4frame | 5frame | 6frame |
|---|---|---|---|---|---|---|
| CH1 | BS(1) | BS(1) | BS(1) | BS(1) | BS(1) | BS(1) |
| CH2 | BS(2) | BS(2) | BS(2) | BS(4) | BS(2) | |
| CH3 | BS(3) | BS(5) | BS(5) | BS(5) | BS(3) | |
| CH4 | BS(4) | BS(7) | BS(7) | BS(6) | BS(4) | |
| CH5 | BS(5) | BS(8) | BS(8) | | BS(5) | |
| CH6 | BS(6) | | | | BS(6) | |
| CH7 | BS(7) | | | | BS(8) | |
| CH8 | BS(8) | | | | | |

FIG. 5

| | 1frame | 2frame | 3frame | 4frame | 5frame | 6frame |
|---|---|---|---|---|---|---|
| CH1 | 0 | 0 | 0 | 0 | 0 | 0 |
| CH2 | 0 | 0 | 0 | 1 | 0 | 1 |
| CH3 | 0 | 1 | 1 | 1 | 0 | 1 |
| CH4 | 0 | 1 | 1 | 0 | 0 | 1 |
| CH5 | 0 | 0 | 0 | 0 | 0 | 1 |
| CH6 | 0 | 1 | 1 | 0 | 0 | 1 |
| CH7 | 0 | 0 | 0 | 1 | 1 | 1 |
| CH8 | 0 | 0 | 0 | 1 | 0 | 1 |

FIG. 6

| | |
|---|---|
| 3da_fragmented_header() { | |
| num_of_audio_element; | 8 bslfb |
| for(i=0;i<num_of_audio_element;i++){ | |
| element_is_cpe[i]; | 1 bslfb |
| } | |
| } | |

FIG. 7

| | |
|---|---|
| 3da_fragmented_data() { | |
| if(3da_fragmented_header_flag==1) { | 1 bslfb |
| 3da_fragmented_header(); | |
| } | |
| for(i=0;i<num_of_audio_element;i++) { | |
| fragment_element_flag[i]; | 1 bslfb |
| } | |
| byte_alignment(); | |
| } | |

DEVICE AND METHOD FOR ENCODING AND DECODING OF AN AUDIO SIGNAL

TECHNICAL FIELD

The present technology relates to an encoding device and method, a decoding device and method, and a program therefor, and more particularly to an encoding device and method, a decoding device and method, and a program therefor capable of improving audio signal transmission efficiency.

BACKGROUND ART

Multichannel encoding based on MPEG (Moving Picture Experts Group)-2 AAC (Advanced Audio Coding) or MPEG-4 AAC, which are international standards, for example, is known as a method for encoding audio signals (refer to Non-patent Document 1, for example).

CITATION LIST

Non-Patent Document

Non-Patent Document 1: INTERNATIONAL STANDARD ISO/IEC 14496-3 Fourth edition 2009-09-01 Information technology-coding of audio-visual objects—part 3: Audio

SUMMARY OF THE INVENTION

Problems to be Solved by the Invention

For reproduction giving higher realistic sensation than conventional 5.1-channel surround reproduction and for transmission of multiple sound materials (objects), a coding technology using more audio channels is required.

For encoding 31 channels at 256 kbps, for example, an average number of bits that can be used per one channel and per one audio frame in coding according to the MPEG AAC standard is about 176 bits. With such a number of bits, however, the sound quality is likely to be significantly deteriorated in encoding of a high bandwidth of 16 kHz or higher using a typical scalar encoding.

In addition, in exiting audio encoding, since an encoding process is also performed on signals that are silent or that can be regarded as being silent, not a small number of bits are required for encoding.

In multichannel low bit-rate encoding, it is important to allocate as many bits as possible for use in encoding channels; while in encoding according to the MPEG AAC standard, the number of bits for encoding a silent frame is 30 to 40 bits per element of each frame. Thus, as the number of silent channels in one frame is larger, the number of bits required or encoding silent data becomes less negligible.

As described above, with the technologies mentioned above, even when signals that need not necessarily be encoded, such as audio signals that are silent or that can be regarded as being silent, are present, the audio signals cannot be transmitted efficiently.

The present technology is achieved in view of the aforementioned circumstances and allows improvement in audio signal transmission efficiency.

Solutions to Problems

An encoding device according to a first aspect of the present technology includes: an encoding unit configured to encode an audio signal when identification information indicating whether or not the audio signal is to be encoded is information indicating that encoding is to be performed, and not to encode the audio signal when the identification information is information indicating that encoding is not to be performed; and a packing unit configured to generate a bit stream containing a first bit stream element in which the identification information is stored, and multiple second bit stream elements in which audio signals of one channel encoded according to the identification information are stored or at least one third bit stream element in which audio signals of two channels encoded according to the identification information are stored.

The encoding device can further be provided with an identification information generation unit configured to generate the identification information according to the audio signal.

When the audio signal is a silent signal, the identification information generation unit can generate the identification information indicating that encoding is not to be performed.

When the audio signal is a signal capable of being regarded as a silent signal, the identification information generation unit can generate the identification information indicating that encoding is not to be performed.

The identification information generation unit can determine whether or not the audio signal is a signal capable of being regarded as a silent signal according to a distance between a sound source position of the audio signal and a sound source position of another audio signal, a level of the audio signal and a level of the another audio signal.

An encoding method or program according to the first aspect of the present technology includes the steps of: encoding an audio signal when identification information indicating whether or not the audio signal is to be encoded is information indicating that encoding is to be performed, and not encoding the audio signal when the identification information is information indicating that encoding is not to be performed; and generating a bit stream containing a first bit stream element in which the identification information is stored, and multiple second bit stream elements in which audio signals of one channel encoded according to the identification information are stored or at least one third bit stream element in which audio signals of two channels encoded according to the identification information are stored.

In the first aspect of the present technology, an audio signal is encoded when identification information indicating whether or not the audio signal is to be encoded is information indicating that encoding is to be performed, and the audio signal is not encoded when the identification information is information indicating that encoding is not to be performed; and a bit stream containing a first bit stream element in which the identification information is stored, and multiple second bit stream elements in which audio signals of one channel encoded according to the identification information are stored or at least one third bit stream element in which audio signals of two channels encoded according to the identification information are stored is generated.

A decoding device according to a second aspect of the present technology includes: an acquisition unit configured to acquire a bit stream containing a first bit stream element in which identification information indicating whether or not to encode an audio signal is stored, and multiple second bit stream elements in which audio signals of one channel encoded according to the identification information indicating that encoding is to be performed are stored or at least one third bit stream element in which audio signals of two channels encoded according to the identification information indicating that encoding is to be performed are stored; an extraction unit configured to extract the identification information and the audio signal from the bit stream; and a decoding unit configured to decode the audio signal extracted from the bit stream and decode the audio signal with the identification information indicating that encoding is not to be performed as a silent signal.

For decoding the audio signal as a silent signal, the decoding unit can set a MDCT coefficient to 0 and perform an IMDCT process to generate the audio signal.

A decoding method or program according to the second aspect of the present technology includes the steps of: acquiring a bit stream containing a first bit stream element in which identification information indicating whether or not to encode an audio signal is stored, and multiple second bit stream elements in which audio signals of one channel encoded according to the identification information indicating that encoding is to be performed are stored or at least one third bit stream element in which audio signals of two channels encoded according to the identification information indicating that encoding is to be performed are stored; extracting the identification information and the audio signal from the bit stream; and decoding the audio signal extracted from the bit stream and decoding the audio signal with the identification information indicating that encoding is not to be performed as a silent signal.

In the second aspect of the present technology, a bit stream containing a first bit stream element in which identification information indicating whether or not to encode an audio signal is stored, and multiple second bit stream elements in which audio signals of one channel encoded according to the identification information indicating that encoding is to be performed are stored or at least one third bit stream element in which audio signals of two channels encoded according to the identification information indicating that encoding is to be performed are stored is acquired; the identification information and the audio signal are extracted from the bit stream; and the audio signal extracted from the bit stream is decoded and the audio signal with the identification information indicating that encoding is not to be performed is decoded as a silent signal.

Effects of the Invention

According to the first aspect and the second aspect of the present technology, audio signal transmission efficiency can be improved.

BRIEF DESCRIPTION OF DRAWINGS

FIG. 3 is a table explaining a status of encoding of each frame for each channel.

FIG. 4 is a table explaining structures of bit streams.

FIG. 5 is a table explaining identification information.

FIG. 6 is a diagram explaining a DSE.

FIG. 7 is a diagram explaining a DSE.

MODE FOR CARRYING OUT THE INVENTION

Embodiments to which the present technology is applied will be described below with reference to the drawings.

First Embodiment

<Outline of the Present Technology>

The present technology improves audio signal transmission efficiency in such a manner that encoded data of multichannel audio signals in units of frames that meet a condition under which the signals can be regarded as being silent or equivalent thereto and thus need not be transmitted are not transmitted. In this case, identification information indicating whether or not to encode audio signals of each channel in units of frames is transmitted to a decoder side, which allows encoded data transmitted to the decoder side to be allocated to right channels.

While a case in which multichannel audio signals are encoded according to the AAC standard will be described in the following, similar processes will be performed in cases in which audio signals are encoded according to other systems.

In the case in which multichannel audio signals are encoded according to the AAC standard and then transmitted, for example, the audio signals of the respective channels are encoded and transmitted in units of frames.

Figure 1:
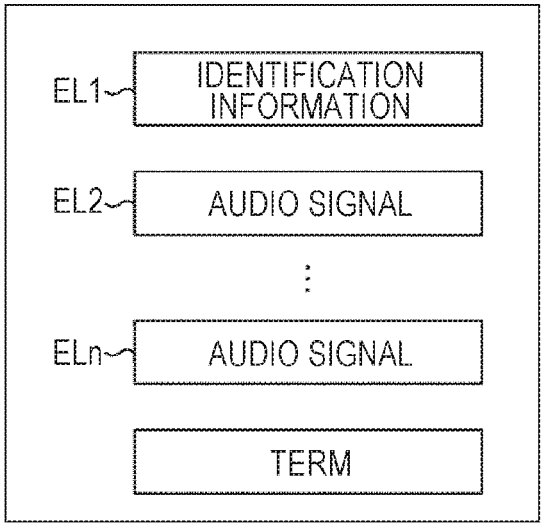
FIG. 1 is a diagram explaining a bit stream.

Specifically, as illustrated in FIG. 1, encoded audio signals and information necessary for decoding and the like of the audio signals are stored in multiple elements (bit stream elements) and bit streams each constituted by such elements are transmitted.

In this example, a bit stream of a frame includes n elements EL1 to ELn arranged in this order from the head, and an identifier TERM arranged at the end and indicating an end position of information of the frame.

The element EL1 arranged at the head, for example, is an ancillary data area called a DSE (Data Stream Element), in which information on multiple channels such as information on downmixing of audio signals and identification information is written.

In the elements EL2 to ELn following the element EL1, encoded audio signals are stored. In particular, an element in which an audio signal of a single channel is stored is called a SCE, and an element in which audio signals of two channels that constitute a pair are stored is called a CPE.

In the present technology, audio signals of channels that are silent or that can be regarded as being silent are not encoded, and such audio signals of channels for which encoding is not performed are not stored in bit streams.

When audio signals of one or more channels are not stored in bit streams, however, it is difficult to identify which channel an audio signal contained in a bit stream belongs to. Thus, in the present technology, identification information indicating whether or not to encode an audio signal of each channel is generated and stored in a DSE.

Figure 2:
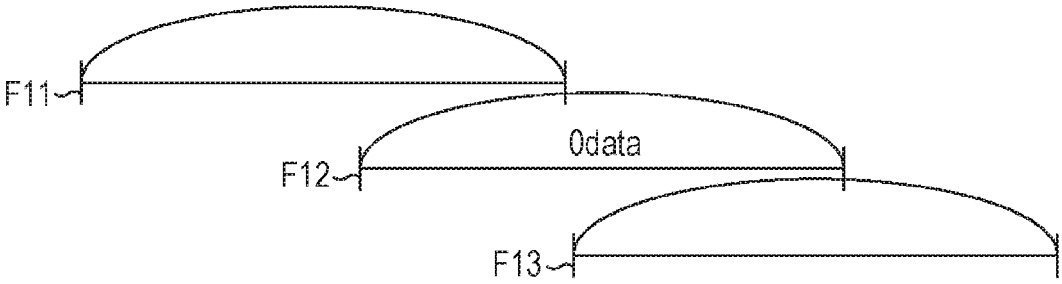
FIG. 2 is a diagram explaining whether or not encoding is required.

Assume, for example, that audio signals of successive frames F11 to F13 as illustrated in FIG. 2 are to be encoded.

In such a case, an encoder determines whether or not to encode an audio signal of each of the frames. For example, the encoder determines whether or not an audio signal is a silent signal on the basis of an amplitude of the audio signal. If the audio signal is a silent signal or can be regarded as being a silent signal, the audio signal of the frame is then determined not to be encoded.

In the example of FIG. 2, since the audio signals of the frames F11 and F13 are not silent, the audio signals are determined to be encoded; and since the audio signal of the frame F12 is a silent signal, the audio signal is determined not to be encoded.

In this manner, the encoder determines whether or not an audio signal of each frame is to be encoded for each channel before encoding audio signals.

More specifically, when two channels, such as an R channel and an L channel, are paired, it is determined whether or not to perform encoding for one pair. Assume, for example, that an R channel and an L channel are paired and that audio signals of these channels are encoded and stored in one CPE (element).

In such a case, when audio signals of both the R channel and the L channel are silent signals or can be regarded as being silent signals, encoding of these audio signals is not to be performed. In other words, when at least one of audio signals of two channels is not silent, encoding of these two audio signals is to be performed.

When encoding of audio signals of respective channels is performed while determination on whether or not encoding is to be performed is made for each channel, or more specifically for each element in this manner, only audible audio signals that are not silent are to be encoded as illustrated in FIG. 3.

In FIG. 3, the vertical direction in the drawing represents channels and the horizontal direction therein represents time, that is, frames. In this example, in the first frame, for example, all of the audio signals of eight channels CH1 to CH8 are encoded.

In the second frame, the audio signals of five channels CH1, CH2, CH5, CH7, and CH8 are encoded and the audio signals of the other channels are not encoded.

Furthermore, in the sixth frame, only the audio signal of the channel CH1 is encoded and the audio signals of the other channels are not encoded.

In a case where encoding of audio signals as illustrated in FIG. 3 is performed, only the encoded audio signals are arranged in order and packed as illustrated in FIG. 4, and transmitted to the decoder. In this example, particularly in the sixth frame, since only the audio signal of the channel CH1 is transmitted, the amount of data in a bit stream can be significantly reduced, and as a result, the transmission efficiency can be improved.

In addition, the encoder generates identification information indicating whether or not each frame of each channel, or more specifically each element, is encoded as illustrated in FIG. 5, and transmits the identification information with the encoded audio signal to the decoder.

In FIG. 5, a number "0" entered in each box represents identification information indicating that encoding has been performed, which a number "1" entered in each box represents identification information indicating that encoding has not been performed. Identification information of one frame for one channel (element) generated by the can be written in one bit. Such identification information of each channel (element) is written for each frame in a DSE.

As a result of determining whether or not to encode an audio signal for each element and writing and transmitting an audio signal encoded where necessary and identification information indicating whether or not encoding of each element has been performed in a bit stream as described above, the transmission efficiency of audio signals can be improved. Furthermore, the number of bits of audio signals that have not been transmitted, that is, the reduced amount of data can be allocated as a code amount for other frames or other audio signals of the current frame to be transmitted. In this manner, the quality of sound of audio signals to be encoded can be improved.

Since the example in which encoding is performed according to the AAC is described herein, identification information is generated for each bit stream element, but identification information may be generated for each channel where necessary according to another system.

When identification information and the like described above are written in a DSE, information shown in FIGS. 6 and 7 is written in a DSE, for example.

FIG. 6 shows syntax of "3da_fragmented_header" contained in a DSE. In this information, "num_of_audio_element" is written as information indicating the number of audio elements contained in a bit stream, that is, the number of elements such as SCEs and CPEs in which encoded audio signals are contained.

After "num_of_audio_element," "element_is_cpe[i]" is written as information indicating whether each element is an element of a single channel or an element of a channel pair, that is, an SCE or a CPE.

Furthermore, FIG. 7 shows syntax of "3da_fragmented_data" contained in a DSE.

In this information, "3da_fragmented_header_flag" that is a flag indicating whether or not "3da_fragmented_header" shown in FIG. 6 is contained in a DSE is written.

Furthermore, when the value of "3da_fragmented_header_flag" is "1" that is a value indicating that "3da_fragmented_header" shown in FIG. 6 is written in a DSE, "3da_fragmented_header" is placed after "3da_fragmented_header_flag."

Furthermore, in "3da_fragmented_data," "fragment_element_flag[i]" that is identification information is written, the number of "fragment_element_flag[i]" corresponding to the number of elements in which audio signals are stored.

<Example Configuration of Encoder>

Next, a specific embodiment of an encoder to which the present technology is applied will be described.

Figure 8:
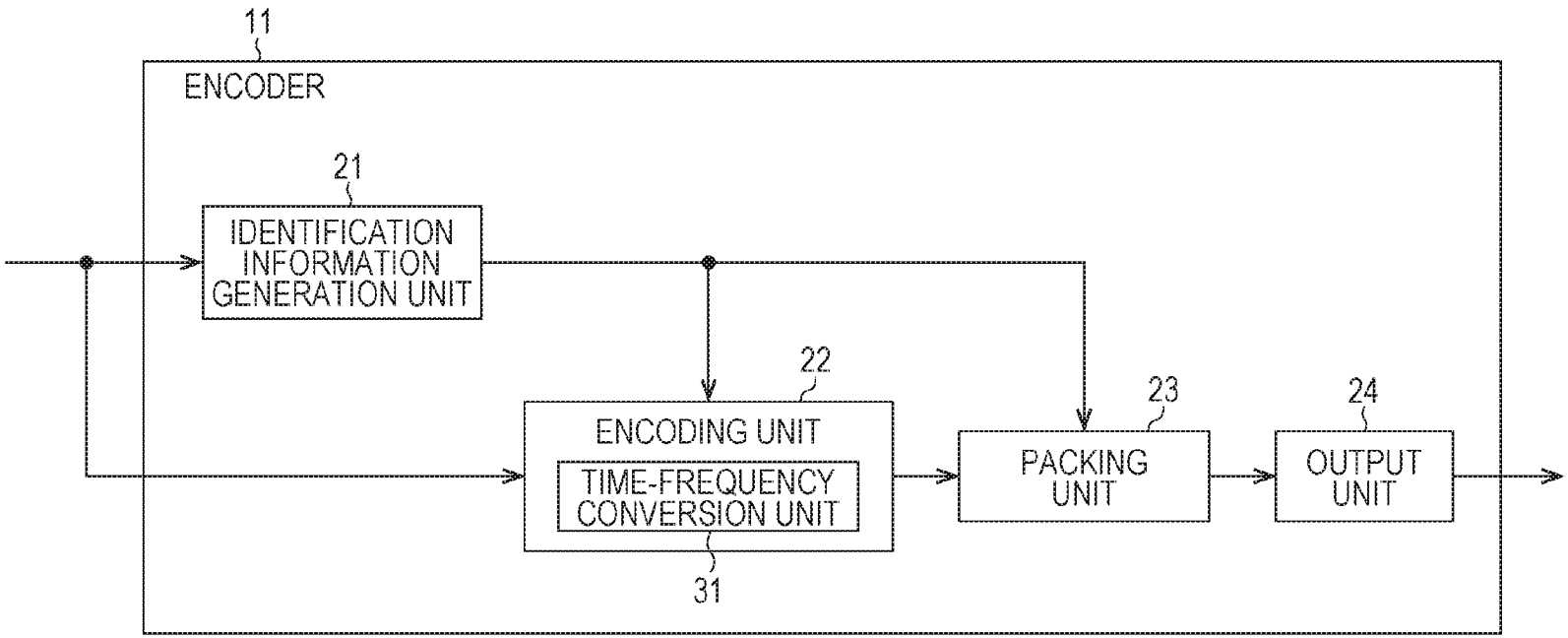
FIG. 8 is a diagram illustrating an example configuration of an encoder.

FIG. 8 is a diagram illustrating an example configuration of the encoder to which the present technology is applied.

The encoder 11 includes an identification information generation unit 21, an encoding unit 22, a packing unit 23, and an output unit 24.

The identification information generation unit 21 determines whether or not an audio signal of each element is to be encoded on the basis of an audio signal supplied from outside, and generates identification information indicating the determination result. The identification information generation unit 21 supplies the generated identification information to the encoding unit 22 and the packing unit 23.

The encoding unit 22 refers to the identification information supplied from the identification information generation unit 21, encodes the audio signal supplied from outside where necessary, and supplies the encoded audio signal (hereinafter also referred to as encoded data) to the packing unit 23. The encoding unit 22 also includes a time-frequency conversion unit 31 that performs time-frequency conversion of an audio signal.

The packing unit 23 packs the identification information supplied from the identification information generation unit 21 and the encoded data supplied from the encoding unit 22 to generate a bit stream, and supplies the bit stream to the output unit 24. The output unit 24 outputs the bit stream supplied from the packing unit 23 to the decoder.

<Explanation of Identification Information Generation Process>

Subsequently, operation of the encoder 11 will be described.

Figure 9:
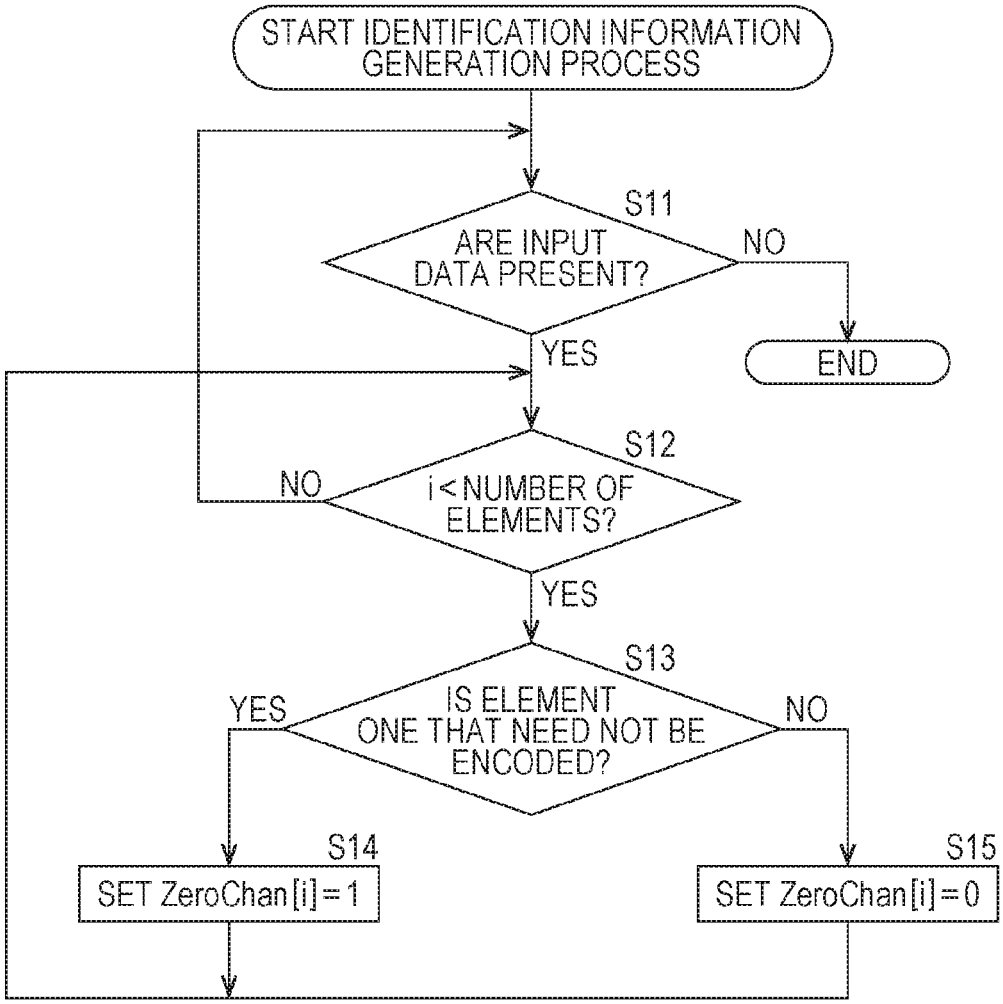
FIG. 9 is a flowchart explaining an identification information generation process.

First, with reference to a flowchart of FIG. 9, an identification information generation process that is a process in which the encoder 11 generates identification information will be described.

In step S11, the identification information generation unit 21 determines whether or not input data are present. If audio signal of elements of one frame are newly supplied from outside, for example, it is determined that input data are present.

If it is determined in step S11 that input data are present, the identification information generation unit 21 determines whether or not a counter i<the number of elements is satisfied in step S12.

The identification information generation unit 21 holds the counter i indicating what number of element is the current element, for example, and at a time point when encoding of an audio signal for a new frame is started, the value of the counter i is 0.

If it is determined that the counter i<the number of elements in step S12, that is, if not all of the elements have not been processed for the current frame, the process proceeds to step S13.

In step S13, the identification information generation unit 21 determines whether or not the i-th element that is the current element is an element that need not be encoded.

If the amplitudes of the audio signal of the current element at some times are not larger than a predetermined threshold, for example, the identification information generation unit 21 determines that the audio signal of the element is silent or can be regarded as being silent and that the element thus need not be encoded.

In this case, when audio signals constituting the element are audio signals of two channels, it is determined that the element need not be encoded if both of the two audio signals are silent or can be regarded as being silent.

If the amplitude of an audio signal is larger than the threshold only at a certain time and the amplitude part at that time is noise, for example, the audio signal may be regarded as being silent.

Furthermore, if the amplitude (sound volume) of an audio signal is much smaller than that of an audio signal of the same frame in another channel and if a sound source position of the audio signal is close to that of the another audio signal of the another channel, for example, the audio signal may be regarded as being silent and may not be encoded. In other words, if a sound source that outputs sound louder than the audio signal of a low volume is close to the sound source of the audio signal, the audio signal from the sound source may be regarded as being a silent signal.

In such a case, it is determined whether or not the audio signal is a signal that can be regarded as being silent on the basis of the distance between the sound source position of the audio signal and the sound source position of the another audio signal and on the levels (amplitudes) of the audio signal and the another audio signal.

If it is determined in step S13 that the current element is an element that need not be encoded, the identification information generation unit 21 sets the value of the identification information ZeroChan[i] of the element to "1" and supplies the value to the encoding unit 22 and the packing unit 23 in step S14. Thus, identification information having a value "1" is generated.

After the identification information is generated for the current element, the counter i is incremented by 1, the process then returns to step S12, and the processing as described above is repeated.

If it is determined in step S13 that the current element is not an element that need not be encoded, the identification information generation unit 21 sets the value of the identification information ZeroChan[i] of the element to "0" and supplies the value to the encoding unit 22 and the packing unit 23 in step S15. Thus, identification information having a value "0" is generated.

After the identification information is generated for the current element, the counter i is incremented by 1, the process then returns to step S12, and the processing as described above is repeated.

If it is determined in step S12 that the counter i<the number of elements is not satisfied, the process returns to step S11, and the processing as described above is repeated.

Furthermore, if it is determined in step S11 that no input data are present, that is, if identification information of the element has been generated for each of all the frames, the identification information generation process is terminated.

As described above, the encoder 11 determines whether or not an audio signal of each element needs to be encoded on the basis of the audio signal, and generates identification information of each element. As a result of generating identification information for each element in this manner, the amount of data of bit streams to be transmitted can be reduced and the transmission efficiency can be improved.

<Explanation of Encoding Process>

Figure 10:
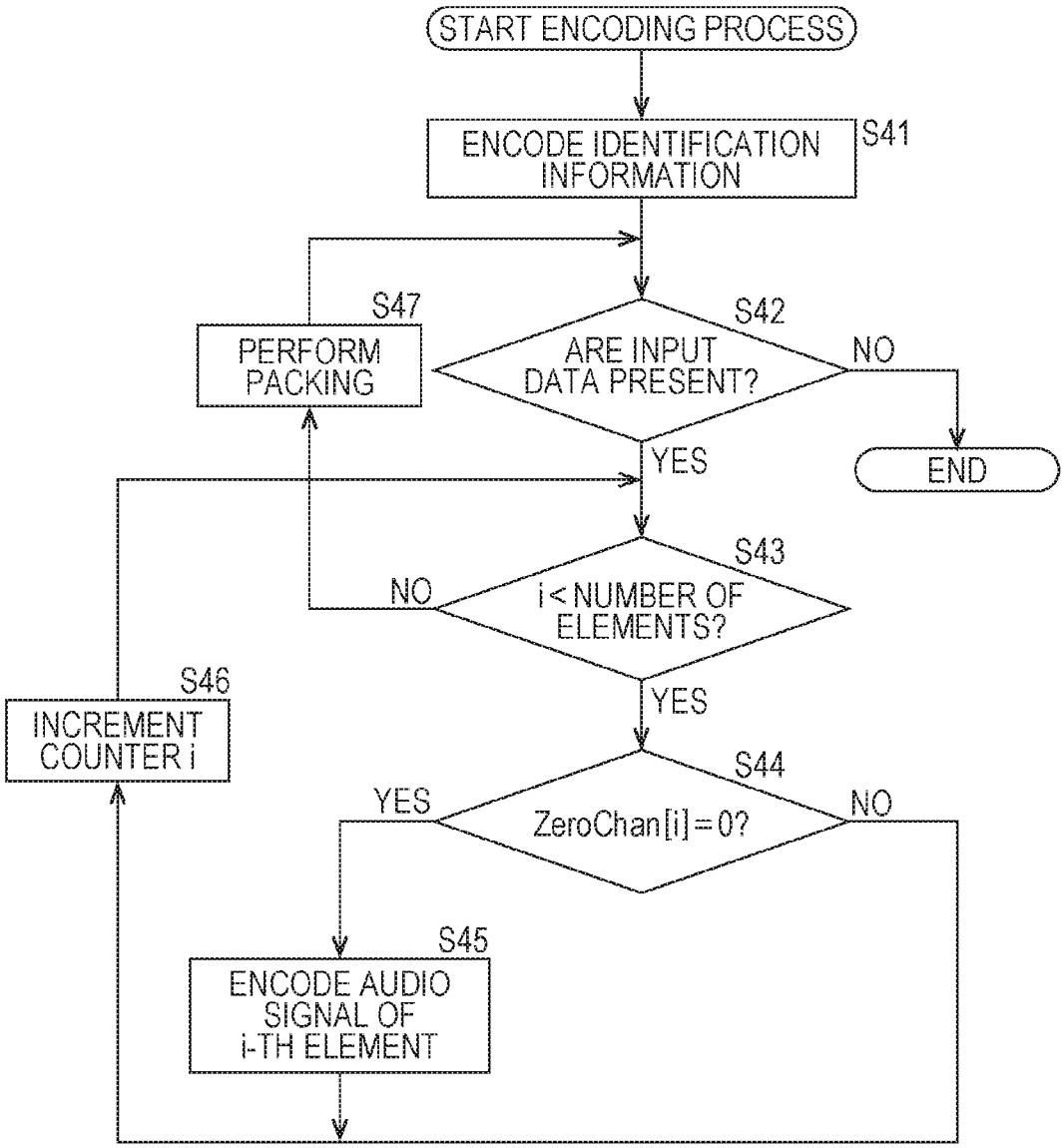
FIG. 10 is a flowchart explaining an encoding process.

Furthermore, an encoding process in which the encoder 11 encodes an audio signal will be described with reference to FIG. 10. This encoding process is performed at the same time as the identification information generation process described with reference to FIG. 9.

In step S41, the packing unit 23 encodes identification information supplied from the identification information generation unit 21.

Specifically, the packing unit 23 encodes the identification information by generating a DSE in which "3da_fragmented_header" shown in FIG. 6 and "3da_fragmented_data" shown in FIG. 7 are contained as necessary on the basis of identification information of elements of one frame.

In step S42, the encoding unit 22 determines whether or not input data are present. If an audio signal of an element of a frame that has not been processed is present, for example, it is determined that input data are present.

If it is determined in step S42 that input data are present, the encoding unit 22 determines whether or not the counter i<the number of elements is satisfied in step S43.

The encoding unit 22 holds the counter i indicating what number of element is the current element, for example, and at a time point when encoding of an audio signal for a new frame is started, the value of the counter i is 0.

If it is determined in step S43 that the counter i<the number of elements is satisfied, the encoding unit 22 determines whether or not the value of the identification information ZeroChan[i] of the i-th element supplied from the identification information generation unit 21 is "0" in step S44.

If it is determined in step S44 that the value of the identification information ZeroChan[i] is "0," that is, if the i-th element needs to be encoded, the process proceeds to step S45.

In step S45, the encoding unit 22 encodes an audio signal of the i-th element supplied from outside.

Specifically, the time-frequency conversion unit 31 performs MDCT (Modified Discrete Cosine Transform) on the audio signal to convert the audio signal from a time signal to a frequency signal.

The encoding unit 22 also encodes a MDCT coefficient obtained by the MDCT on the audio signal, and obtains a scale factor, side information, and quantized spectra. The encoding unit 22 then supplies the obtained scale factor, side information and quantized spectra as encoded data resulting from encoding the audio signal to the packing unit 23.

After the audio signal is encoded, the process proceeds to step S46.

If it is determined in step S44 that the value of the identification information ZeroChan[i] is "1," that is, if the i-th element need not be encoded, the process skips the processing in step S45 and proceeds to step S46. In this case, the encoding unit 22 does not encode the audio signal.

If it is determined in step S45 that the audio signal has been encoded or if it is determined in step S44 that the value of the identification information ZeroChan[i] "1," the encoding unit 22 increments the value of the counter i by 1 in step S46.

After the counter i is updated, the process returns to step S43 and the processing described above is repeated.

If it is determined in step S43 that the counter i<the number of elements is not satisfied, that is if encoding has been performed on all the elements of the current frame, the process proceeds to step S47.

In step S47, the packing unit 23 packs the DSE obtained by encoding the identification information and the encoded data supplied from the encoding unit 22 to generate a bit stream.

Specifically, the packing unit 23 generates a bit stream that contains SCEs and CPEs in which encoded data are stored, a DSE, and the like for the current frame, and supplies the bit stream to the output unit 24. In addition, the output unit 24 outputs the bit stream supplied from the packing unit 23 to the decoder.

After the bit stream of one frame is output, the process returns to step S42 and the processing described above is repeated.

Furthermore, if it is determined in step S42 that no input data are present, that is, if bit streams are generated and output for all the frames, the encoding process is terminated.

As described above, the encoder 11 encodes an audio signal according to the identification information and generates a bit stream containing the identification information and encoded data. As a result of generating bit streams containing identification information of respective elements and encoded data of encoded elements among multiple elements in this manner, the amount of data of bit streams to be transmitted can be reduced. Consequently, the transmission efficiency can be improved. Note that the example in which identification information of multiple channels, that is, multiple identification information data are stored in a DSE in a bit stream of one frame has been described. However, in such cases where audio signals are not multichannel signals, for example, identification information of one channel, that is, one piece of identification information may be stored in a DSE in a bit stream of one frame.

<Example Configuration of Decoder>

Next, a decoder that receives bit streams output from the encoder 11 and decodes audio signals will be described.

Figure 11:
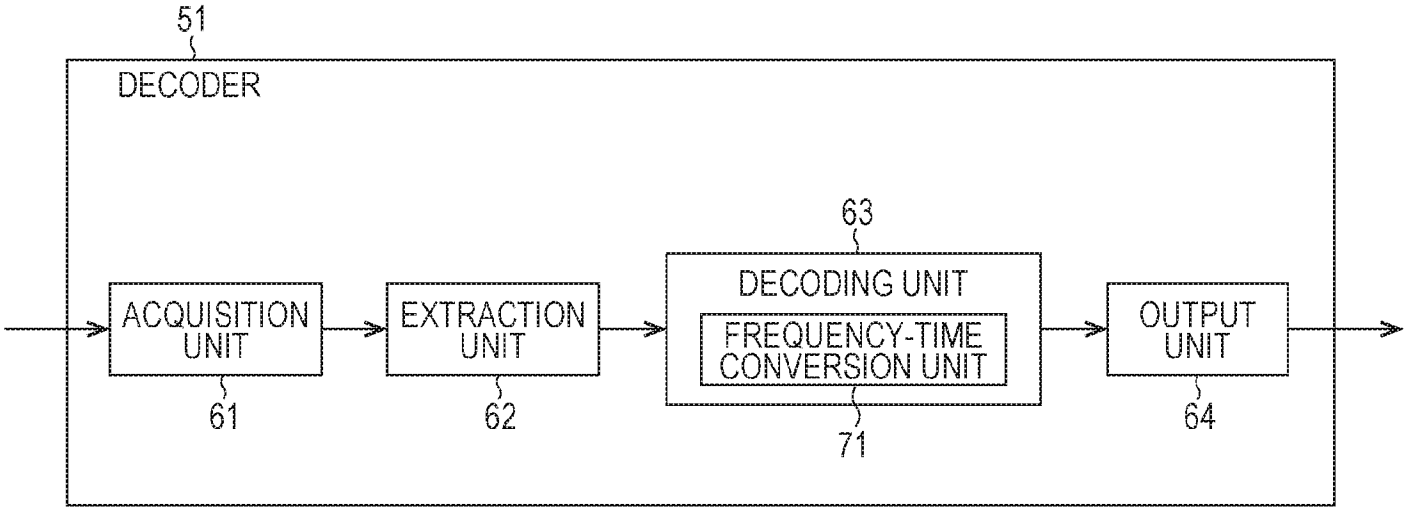
FIG. 11 is a diagram illustrating an example configuration of a decoder.

FIG. 11 is a diagram illustrating an example configuration of the decoder to which the present technology is applied.

The decoder 51 of FIG. 11 includes an acquisition unit 61, an extraction unit 62, a decoding unit 63, and an output unit 64.

The acquisition unit 61 acquires a bit stream from the encoder 11 and supplies the bit stream to the extraction unit 62. The extraction unit 62 extracts identification information from the bit stream supplied from the acquisition unit 61, sets a MDCT coefficient and supplies the MDCT coefficient to the decoding unit 63 where necessary, extracts encoded data from the bit stream and supplies the encoded data to the decoding unit 63.

The decoding unit 63 decodes the encoded data supplied from the extraction unit 62. Furthermore, the decoding unit 63 includes a frequency-time conversion unit 71. The frequency-time conversion unit 71 performs IMDCT (Inverse Modified Discrete Cosine Transform) on the basis of a MDCT coefficient obtained as a result of decoding of the encoded data by the decoding unit 63 or a MDCT coefficient supplied from the extraction unit 62. The decoding unit 63 supplies an audio signal obtained by the IMDCT to the output unit 64.

The output unit 64 outputs an audio signals of each frame in each channel supplied from the decoding unit 63 to a subsequent reproduction device or the like.

<Explanation of Decoding Process>

Subsequently, operation of the decoder 51 will be described.

When a bit stream is transmitted from the encoder 11, the decoder 51 starts a decoding process of receiving and decoding the bit stream.

Figure 12:
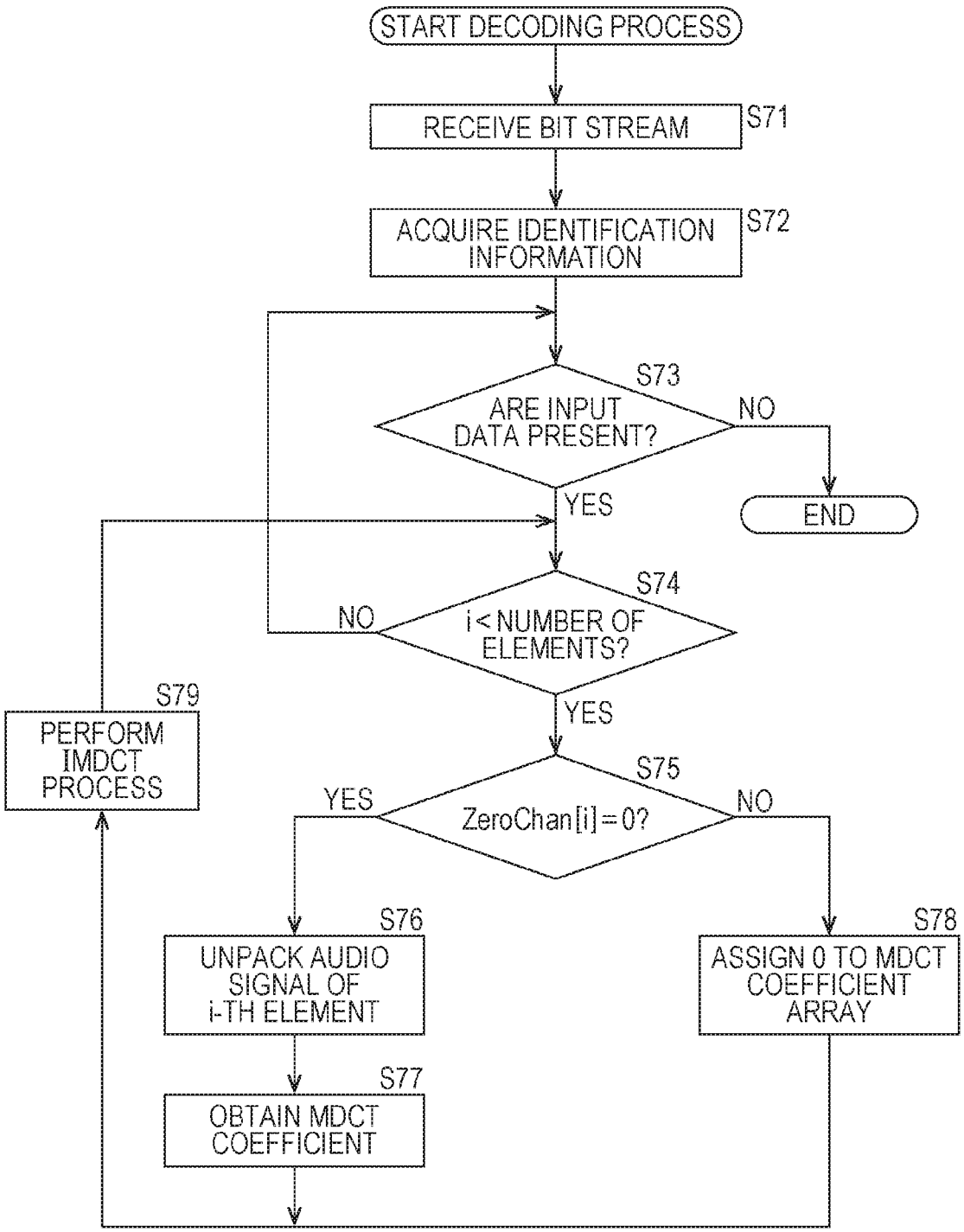
FIG. 12 is a flowchart explaining a decoding process.

Hereinafter, the decoding process performed by the decoder 51 will be described with reference to the flowchart of FIG. 12.

In step S71, the acquisition unit 61 receives a bit stream transmitted from the encoder 11 and supplies the bit stream to the extraction unit 62. In other words, a bit stream is acquired.

In step S72, the extraction unit 62 acquires identification information from a DSE of the bit stream supplied from the acquisition unit 61. In other words, the identification information is decoded.

In step S73, the extraction unit 62 determines whether or not input data are present. If a frame that has not been processed is present, for example, it is determined that input data are present.

If it is determined in step S73 that input data are present, the extraction unit 62 determines whether or not the counter i<the number of elements is satisfied in step S74.

The extraction unit 62 holds the counter i indicating what number of element is the current element, for example, and at a time point when decoding of an audio signal for a new frame is started, the value of the counter i is 0.

If it is determined in step S74 that the counter i<the number of elements is satisfied, the extraction unit 62 determines whether or not the value of the identification information ZeroChan[i] of the i-th element that is the current element is "0" in step S75.

If it is determined in step S75 that the value of the identification information ZeroChan[i] is "0," that is, if the audio signal has been encoded, the process proceeds to step S76.

In step S76, the extraction unit 62 unpacks the audio signal, that is, the encoded data of the i-th element that is the current element.

Specifically, the extraction unit 62 reads encoded data of a SCE or a CPE that is the current element of a bit stream from the element, and supplies the encoded data to the decoding unit 63.

In step S77, the decoding unit 63 decodes the encoded data supplied from the extraction unit 62 to obtain a MDCT coefficient, and supplies the MDCT coefficient to the frequency-time conversion unit 71. Specifically, the decoding unit 63 calculates the MDCT coefficient on the basis of a scale factor, side information, and quantized spectra supplied as the encoded data.

After the MDCT coefficient is calculated, the process proceeds to step S79.

If it is determined in step S75 that the value of the identification information ZeroChan[i] is "1," that is, if the audio signal has not been encoded, the process proceeds to step S78.

In step S78, the extraction unit 62 assigns "0" to the MDCT coefficient array of the current element, and supplies the MDCT coefficient array to the frequency-time conversion unit 71 of the decoding unit 63. In other words, each MDCT coefficient of the current element is set to "0." In this case, the audio signal is decoded on the assumption that the audio signal is a silent signal.

After the MDCT coefficient is supplied to the frequency-time conversion unit 71, the process proceeds to step S79.

After the MDCT coefficient is supplied to the frequency-time conversion unit 71 in step S77 or in step S78, the frequency-time conversion unit 71 performs an IMDCT process on the basis of the MDCT coefficient supplied from the extraction unit 62 or the decoding unit 63 in step S79. Specifically, frequency-time conversion of the audio signal is performed, and an audio signal that is a time signal is obtained.

The frequency-time conversion unit 71 supplies the audio signal obtained by the IMDCT process to the output unit 64. The output unit 64 outputs the audio signal supplied from the frequency-time conversion unit 71 to a subsequent component.

When the audio signal obtained by decoding is output, the extraction unit 62 increments the counter i held by the extraction unit 62 by 1, and the process returns to step S74.

If it is determined in step S74 that the counter i<the number of elements is not satisfied, the process returns to step S73, and the processing as described above is repeated.

Furthermore, if it is determined in step S73 that no input data are present, that is, if audio signals of all the frames have been decoded, the decoding process is terminated.

As described above, the decoder 51 extracts identification information from a bit stream, and decodes an audio signal according to the identification information. As a result of performing decoding using identification information in this manner, unnecessary data need not be stored in a bit stream, and the amount of data of transmitted bit streams can be reduced. Consequently, the transmission efficiency can be improved.

The series of processes described above can be performed either by hardware or by software. When the series of processes described above is performed by software, programs constituting the software are installed in a computer. Note that examples of the computer include a computer embedded in dedicated hardware and a general-purpose computer capable of executing various functions by installing various programs therein.

Figure 13:
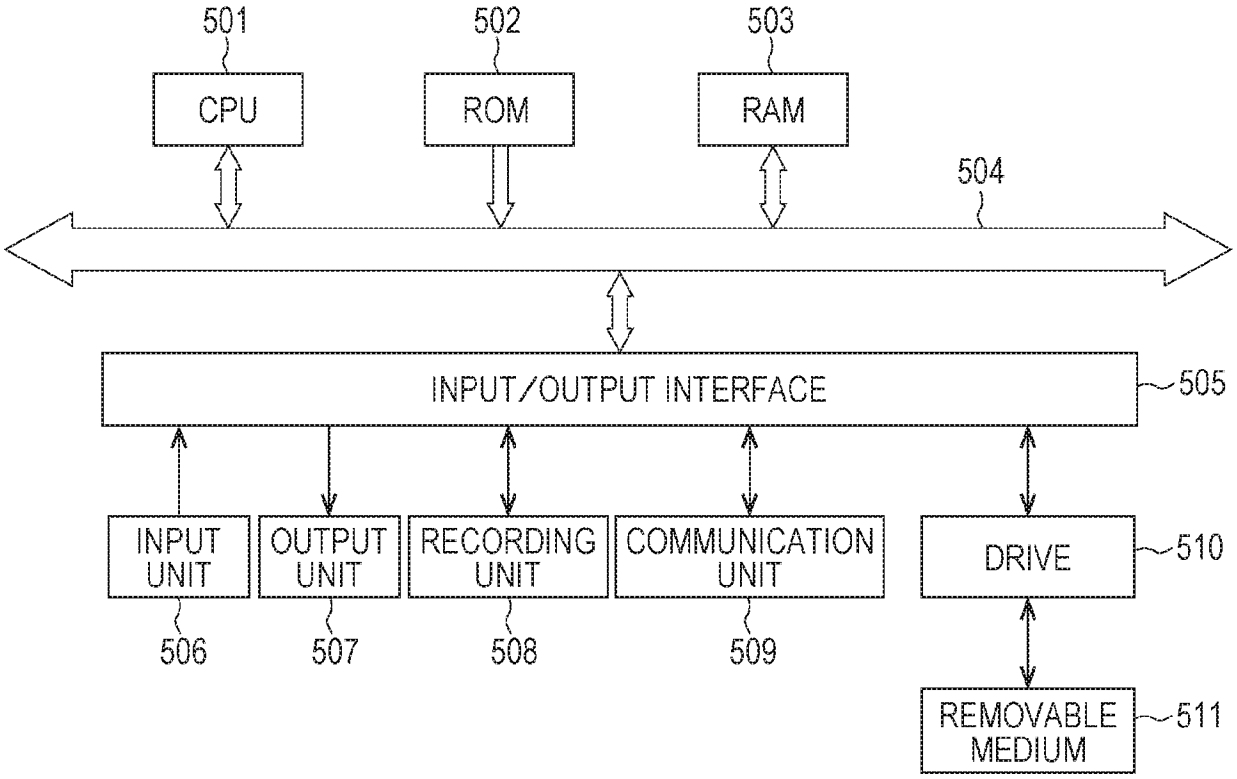
FIG. 13 is a diagram illustrating an example configuration of a computer.

FIG. 13 is a block diagram showing an example structure of the hardware of a computer that performs the above described series of processes in accordance with programs.

In the computer, a CPU 501, a ROM 502, and a RAM 503 are connected to one another via a bus 504.

An input/output interface 505 is further connected to the bus 504. An input unit 506, an output unit 507, a recording unit 508, a communication unit 509, and a drive 510 are connected to the input/output interface 505.

The input unit 506 includes a keyboard, a mouse, a microphone, an image sensor, and the like. The output unit 507 includes a display, a speaker, and the like. The recording unit 508 is a hard disk, a nonvolatile memory, or the like. The communication unit 509 is a network interface or the like. The drive 510 drives a removable medium 511 such as a magnetic disk, an optical disk, a magnetooptical disk, or a semiconductor memory.

In the computer having the above described structure, the CPU 501 loads a program recorded in the recording unit 508 into the RAM 503 via the input/output interface 505 and the bus 504 and executes the program, for example, so that the above described series of processes are performed.

Programs to be executed by the computer (CPU 501) may be recorded on a removable medium 511 that is a package medium or the like and provided therefrom, for example. Alternatively, the programs can be provided via a wired or wireless transmission medium such as a local area network, the Internet, or digital satellite broadcasting.

In the computer, the programs can be installed in the recording unit 508 via the input/output interface 505 by mounting the removable medium 511 on the drive 510. Alternatively, the programs can be received by the communication unit 509 via a wired or wireless transmission medium and installed in the recording unit 508. Still alternatively, the programs can be installed in advance in the ROM 502 or the recording unit 508.

Programs to be executed by the computer may be programs for carrying out processes in chronological order in accordance with the sequence described in this specification, or programs for carrying out processes in parallel or at necessary timing such as in response to a call.

Furthermore, embodiments of the present technology are not limited to the embodiments described above, but various modifications may be made thereto without departing from the scope of the technology.

For example, the present technology can be configured as cloud computing in which one function is shared by multiple devices via a network and processed in cooperation.

In addition, the steps explained in the above flowcharts can be performed by one device and can also be shared among multiple devices.

Furthermore, when multiple processes are included in one step, the processes included in the step can be performed by one device and can also be shared among multiple devices.

Furthermore, the present technology can have the following configurations.

[1]

An encoding device including:

an encoding unit configured to encode an audio signal when identification information indicating whether or not the audio signal is to be encoded is information indicating that encoding is to be performed, and not to encode the audio signal when the identification information is information indicating that encoding is not to be performed; and a packing unit configured to generate a bit stream containing a first bit stream element in which the identification information is stored, and multiple second bit stream elements in which audio signals of one channel encoded according to the identification information are stored or at least one third bit stream element in which audio signals of two channels encoded according to the identification information are stored.

[2]

The encoding device described in [1], further including an identification information generation unit configured to generate the identification information according to the audio signal.

[3]

The encoding device described in [2], wherein when the audio signal is a silent signal, the identification information generation unit generates the identification information indicating that encoding is not to be performed

[4]

The encoding device described in [2], wherein when the audio signal is a signal capable of being regarded as a silent signal, the identification information generation unit generates the identification information indicating that encoding is not to be performed.

[5]

The encoding device described in [4], wherein the identification information generation unit determines whether or not the audio signal is a signal capable of being regarded as a silent signal according to a distance between a sound source position of the audio signal and a sound source position of another audio signal, a level of the audio signal and a level of the another audio signal.

[6]

An encoding method including the steps of: encoding an audio signal when identification information indicating whether or not the audio signal is to be encoded is information indicating that encoding is to be performed, and not encoding the audio signal when the identification information is information indicating that encoding is not to be performed; and generating a bit stream containing a first bit stream element in which the identification information is stored, and multiple second bit stream elements in which audio signals of one channel encoded according to the identification information are stored or at least one third bit stream element in which audio signals of two channels encoded according to the identification information are stored.

[7]

A program causing a computer to execute a process including the steps of: encoding an audio signal when identification information indicating whether or not the audio signal is to be encoded is information indicating that encoding is to be performed, and not encoding the audio signal when the identification information is information indicating that encoding is not to be performed; and generating a bit stream containing a first bit stream element in which the identification information is stored, and multiple second bit stream elements in which audio signals of one channel encoded according to the identification information are stored or at least one third bit stream element in which audio signals of two channels encoded according to the identification information are stored.

[8]

A decoding device including:

an acquisition unit configured to acquire a bit stream containing a first bit stream element in which identification information indicating whether or not to encode an audio signal is stored, and multiple second bit stream elements in which audio signals of one channel encoded according to the identification information indicating that encoding is to be performed are stored or at least one third bit stream element in which audio signals of two channels encoded according to the identification information indicating that encoding is to be performed are stored;

an extraction unit configured to extract the identification information and the audio signal from the bit stream; and a decoding unit configured to decode the audio signal extracted from the bit stream and decode the audio signal with the identification information indicating that encoding is not to be performed as a silent signal.

[9]

The decoding device described in [8], wherein for decoding the audio signal as a silent signal, the decoding unit sets a MDCT coefficient to 0 and performs an IMDCT process to generate the audio signal.

[10]

A decoding method including the steps of:

acquiring a bit stream containing a first bit stream element in which identification information indicating whether or not to encode an audio signal is stored, and multiple second bit stream elements in which audio signals of one channel encoded according to the identification information indicating that encoding is to be performed are stored or at least one third bit stream element in which audio signals of two channels encoded according to the identification information indicating that encoding is to be performed are stored;

extracting the identification information and the audio signal from the bit stream; and decoding the audio signal extracted from the bit stream and decoding the audio signal with the identification information indicating that encoding is not to be performed as a silent signal.

[11]

A program causing a computer to execute a process including the steps of:

acquiring a bit stream containing a first bit stream element in which identification information indicating whether or not to encode an audio signal is stored, and multiple second bit stream elements in which audio signals of one channel encoded according to the identification information indicating that encoding is to be performed are stored or at least one third bit stream element in which audio signals of two channels encoded according to the identification information indicating that encoding is to be performed are stored;

extracting the identification information and the audio signal from the bit stream; and decoding the audio signal extracted from the bit stream and decoding the audio signal with the identification information indicating that encoding is not to be performed as a silent signal.

REFERENCE SIGNS LIST

11 Encoder
21 Identification information generation unit
22 Encoding unit
23 Packing unit
24 Output unit
31 Time-frequency conversion unit
51 Decoder
61 Acquisition unit
62 Extraction unit
63 Decoding unit
64 Output unit
71 Frequency-time conversion unit

The invention claimed is:

1. An encoding device, comprising:

one or more processors configured to:

encode an audio signal of a plurality of audio signals based on identification information, wherein the identification information indicates one of execution of an encoding operation or prevention of the encoding operation;

control the prevention of the encoding operation for at least one audio signal of the plurality of audio signals based on the identification information that corresponds to the prevention of the encoding operation on the at least one audio signal, wherein the prevention of the encoding operation is based on an amplitude of the at least one audio signal that is larger than a threshold value; and generate a bit stream, wherein the bit stream comprises at least one of a first bit stream element, multiple second bit stream elements or at least one third bit stream element, wherein the first bit stream element stores the identification information, wherein the multiple second bit stream elements store a first set of audio signals of the plurality of audio signals, wherein the first set of audio signals are associated with one channel that is encoded based on the identification information, wherein the at least one third bit stream element stores a second set of audio signals of the plurality of audio signals, and wherein the second set of audio signals are associated with two channels that are encoded based on the identification information.

2. The encoding device according to claim 1, wherein the one or more processors are further configured to generate the identification information based on the audio signal.

3. The encoding device according to claim 2, the one or more processors are further configured to generate the identification information, wherein the identification information indicating the prevention of the encoding operation is generated based on the at least one audio signal that is a silent signal.

4. The encoding device according to claim 2, the one or more processors are further configured to generate the identification information, wherein the identification information indicates the prevention of the encoding operation based on the at least one audio signal that corresponds to a silent signal.

5. The encoding device according to claim 4, wherein the one or more processors are further configured to determine silent signal status of the at least one audio signal based on at least one of a distance between a first sound source position of a first source audio signal and a second sound source position of a second source audio signal or a first level of the first source audio signal and a second level of the second source audio signal.

6. An encoding method, comprising:

encoding an audio signal of a plurality of audio signals based on identification information, wherein the identification information indicating one of execution of an encoding operation or prevention of the encoding operation;

controlling the prevention of the encoding operation for at least one audio signal of the plurality of audio signals based on the identification information that corresponds to the prevention of the encoding operation on the at least one audio signal, wherein the prevention of the encoding operation is based on an amplitude of the at least one audio signal that is larger than a threshold value; and generating a bit stream, wherein the bit stream comprises at least one of a first bit stream element, multiple second bit stream elements or at least one third bit stream element, wherein the first bit stream element stores the identification information, wherein the multiple second bit stream elements store a first set of audio signals of the plurality of audio signals, wherein the first set of audio signals are associated with one channel that is encoded based on the identification information, wherein the at least one third bit stream element stores a second set of audio signals of the plurality of audio signals, and wherein the second set of audio signals are associated with two channels that are encoded based on the identification information.

7. A non-transitory computer-readable medium having stored thereon computer-readable instructions, which when executed by a computer, cause the computer to execute operations, the operations comprising:

encoding an audio signal of a plurality of audio signals based on identification information, wherein the identification information indicating one of execution of an encoding operation or prevention of the encoding operation;

controlling the prevention of the encoding operation for at least one audio signal of the plurality of audio signals based on the identification information that corresponds to the prevention of the encoding operation on the at least one audio signal, wherein the prevention of the encoding operation is based on an amplitude of the at least one audio signal that is larger than a threshold value; and generating a bit stream, wherein the bit stream comprises at least one of a first bit stream element, multiple second bit stream elements or at least one third bit stream element, wherein the first bit stream element stores the identification information, wherein the multiple second bit stream elements store a first set of audio signals of the plurality of audio signals, and wherein the first set of audio signals are associated with one channel that is encoded based on the identification information, wherein the at least one third bit stream element stores a second set of audio signals of the plurality of audio signals, and wherein the second set of audio signals are associated with two channels that are encoded based on the identification information.

8. A decoding device, comprising:

one or more processors configured to:

acquire a bit stream, wherein the bit stream comprises at least one of a first bit stream element, multiple second bit stream elements or at least one third bit stream element, wherein the first bit stream element stores identification information, wherein the identification information indicating execution of an encoding operation of an audio signal of a plurality of audio signals or prevention of the encoding operation for at least one audio signal of the plurality of audio signals are stored, wherein the multiple second bit stream elements store a first set of audio signals of the plurality of audio signals, wherein the first set of audio signals are associated with one channel that is encoded based on the identification information, wherein the at least one third bit stream element stores a second set of audio signals of the plurality of audio signals, and wherein the second set of audio signals are associated with two channels that are encoded based on the identification information;

extract the identification information and the audio signal from the bit stream; and decode the audio signal extracted from the bit stream based on the identification information, wherein the identification information indicates the prevention of the encoding operation based on an amplitude of the at least one audio signal that is lower than a threshold value.

9. The decoding device according to claim 8, wherein the one or more processors are further configured to:

set a Modified Discrete Cosine Transform (MDCT) coefficient to a value of 0 and execute an Inverse Modified Discrete Cosine Transform (IMDCT) process to generate the audio signal.

10. A decoding method, comprising:

acquiring a bit stream, wherein the bit stream comprises at least one of a first bit stream element, multiple second bit stream elements or at least one third bit stream element, wherein the first bit stream element stores identification information, wherein the identification information indicating execution of an encoding operation of an audio signal of a plurality of audio signals or prevention of the encoding operation for at least one audio signal of the plurality of audio signals are stored, wherein the multiple second bit stream elements store a first set of audio signals of the plurality of audio signals, wherein the first set of audio signals are associated with one channel that is encoded based on the identification information, wherein the at least one third bit stream element stores a second set of audio signals of the plurality of audio signals, and wherein the second set of audio signals are associated with two channels that are encoded based on the identification information;

extracting the identification information and the audio signal from the bit stream; and decoding the audio signal extracted from the bit stream based on the identification information, wherein the identification information indicates the prevention of the encoding operation based on an amplitude of the at least one audio signal that is lower than a threshold value.

11. A non-transitory computer-readable medium having stored thereon computer-readable instructions, which when executed by a computer, cause the computer to execute operations, the operations comprising:

acquiring a bit stream, wherein the bit stream comprises at least one of a first bit stream element, multiple second bit stream elements or at least one third bit stream element, wherein the first bit stream element stores identification information, wherein the identification information indicating execution of an encoding operation of an audio signal of a plurality of audio signals or prevention of the encoding operation for at least one audio signal of the plurality of audio signals are stored, wherein the multiple second bit stream elements store a first set of audio signals of the plurality of audio signals, wherein the first set of audio signals are associated with one channel that is encoded based on the identification information, wherein the at least one third bit stream element stores a second set of audio signals of the plurality of audio signals, and wherein the second set of audio signals are associated with two channels that are encoded based on the identification information;

extracting the identification information and the audio signal from the bit stream; and decoding the audio signal extracted from the bit stream based on the identification information, wherein the identification information indicates the prevention of the encoding operation based on an amplitude of the at least one audio signal that is lower than a threshold value.

* * * * *